US010434032B2

(12) United States Patent
Ghosh et al.

(10) Patent No.: US 10,434,032 B2
(45) Date of Patent: Oct. 8, 2019

(54) INSTRUMENT-ASSISTED SOFT TISSUE MOBILIZATION TOOL

(71) Applicants: Jaya Ghosh, Columbia, MO (US); Ellie Koehly, Columbia, MO (US); Yaw Sarpong, Columbia, MO (US); Roger de la Torre, Columbia, MO (US); Jonathon Buehler, Columbia, MO (US); Brett Hayes, Columbia, MO (US); Teresa Graff, Columbia, MO (US); Katherina Chen, Columbia, MO (US)

(72) Inventors: Jaya Ghosh, Columbia, MO (US); Ellie Koehly, Columbia, MO (US); Yaw Sarpong, Columbia, MO (US); Roger de la Torre, Columbia, MO (US); Jonathon Buehler, Columbia, MO (US); Brett Hayes, Columbia, MO (US); Teresa Graff, Columbia, MO (US); Katherina Chen, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 430 days.

(21) Appl. No.: 14/969,862

(22) Filed: Dec. 15, 2015

(65) Prior Publication Data

US 2016/0166459 A1 Jun. 16, 2016

Related U.S. Application Data

(60) Provisional application No. 62/124,334, filed on Dec. 15, 2014.

(51) Int. Cl.
*A61H 7/00* (2006.01)

(52) U.S. Cl.
CPC ..... *A61H 7/001* (2013.01); *A61H 2201/0153* (2013.01); *A61H 2201/1695* (2013.01)

(58) Field of Classification Search
CPC ..... A61H 7/00–005; A61H 7/007; A61H 9/0021–0028; A61H 15/0085–0092;
(Continued)

(56) References Cited

U.S. PATENT DOCUMENTS 4,269,176 A * 5/1981 Beyer ..... A61B 8/4281 403/223
6,283,930 B1 * 9/2001 Purvis ..... A46B 5/0033 15/185

(Continued)

*Primary Examiner* — Rachel T Sippel
(74) *Attorney, Agent, or Firm* — Sandberg Phoenix & von Gontard P.C.

(57) ABSTRACT

A tool for use in assisting soft tissue mobilization and bodily tissue amelioration, such as stimulation of superficial tissue, deep tissue mobilization, breaking up scar tissue, and soft tissue massaging, are described. The tool comprises a device for application to bodily tissue that includes a body having a substantially teardrop shape in a vertical section. In a longitudinal aspect, the body includes a first and a second portion. The first portion of the device corresponds at least in part to a substantially bulbous handle part of the teardrop shape of the vertical section and is adapted for ease of grasping and manipulation at the first end. The second portion of the device corresponds at least in part to a substantially tapered converging double-beveled linear edge of the teardrop shape of the vertical section and is adapted for facilitated application of the device to bodily tissue at the second end.

19 Claims, 7 Drawing Sheets

(58) Field of Classification Search
CPC .. A61H 2300/00–06; A61H 2201/0153; A61H 2201/1253; A61H 2201/1635
See application file for complete search history.

(56) References Cited

U.S. PATENT DOCUMENTS

| | | | | |
|---|---|---|---|---|
| 6,887,211 | B1 * | 5/2005 | Sevier | A61H 7/001 601/135 |
| 8,801,642 | B1 * | 8/2014 | Slominski | A61H 7/001 601/134 |
| 2003/0144618 | A1 * | 7/2003 | Harmon | A61H 1/0292 601/136 |
| 2007/0191745 | A1 * | 8/2007 | Tucker | A61H 7/00 601/135 |
| 2012/0158040 | A1 * | 6/2012 | Dehors | A61H 7/003 606/201 |
| 2015/0265486 | A1 * | 9/2015 | Fiore | A61H 7/003 601/136 |

* cited by examiner

INSTRUMENT-ASSISTED SOFT TISSUE MOBILIZATION TOOL

CROSS-REFERENCE TO RELATED APPLICATIONS

This Non-Provisional application claims priority to U.S. Provisional Application Ser. No. 62/124,334 filed Dec. 15, 2014 and which is incorporated herein by reference.

STATEMENT REGARDING FEDERALLY SPONSORED RESEARCH

Not applicable.

FIELD OF THE INVENTION

The present invention relates to the field of devices and methods for soft tissue mobilization, and more specifically, to a soft tissue mobilization tool and methods for its use providing multiple modalities and ergonomic and comfortable gripping.

BACKGROUND OF THE INVENTION

Instrument-assisted soft tissue mobilization (IASTM) can be dated to ancient eastern medicine practice, such as the Chinese "Gua Sha" practice. Many studies have shown that IASTM has been effective in promoting soft tissue (such as tendons, muscles, ligaments, and myofascia) amelioration and healing by various mechanisms including stimulating the inflammatory process to increase blood flow to an area of injury and initiating the healing process to help break up scar tissue.

Currently, there are several types of IASTM devices on the market. However, many of the conventional devices are uncomfortable to hold (causing unnecessary strain on users' wrists and hands), difficult to use, costly and may require extensive training to operate, which are the primary limitations to widespread utilization of IASTM tools. Furthermore, such conventional devices are often not readily customizable to different hand sizes. Moreover, effective treatments frequently require multiple instruments from multiple manufacturers.

Therefore, there is a need to develop a new set of IASTM tools that are affordable and easy to use with multifunctional modalities and ergonomic and comfortable gripping.

SUMMARY OF THE INVENTION

A device and methods for its use in assisting soft tissue mobilization and amelioration (such as stimulation of superficial tissue, deep tissue mobilization, breaking up scar tissue, and soft tissue massaging) are described. The inventive tool comprises a device for application to bodily tissue, the device including a body having a substantially teardrop shape in a vertical section. In a longitudinal aspect, the body includes a first and a second portion toward corresponding first and second ends of the device. The first portion of the device corresponds at least in part to a substantially bulbous handle part of the teardrop shape of the vertical section and is adapted for ease of grasping and manipulation at the first end. The second portion of the device corresponds at least in part to a substantially tapered converging double-beveled linear edge of the teardrop shape of the vertical section and is adapted for facilitated application of the device to bodily tissue at the second end.

In another aspect, a device comprising a combination of multiple enhancements for application to bodily tissue is provided. This device includes a body having a substantially teardrop shape in a vertical section. In a longitudinal aspect, the device's body includes a first and second portion toward corresponding first and second ends of the device. The first portion includes a substantially bulbous handle part corresponding at least in part to the bulbous portion of the teardrop shape of the aforementioned vertical section and is adapted for ease of grasping and manipulation at the first end of the device. The second portion corresponds to a substantially tapered converging double-beveled linear edge in the narrowed portion of the teardrop shape of the vertical section and is adapted for facilitated application to bodily tissue at this second end. In a lateral aspect, the first, handle, portion comprises at least a generally cylindrical or partially cylindrical shape. The device has a maximum dimension of from about 7.5 cm to about 11.5 cm in its longitudinal aspect and a maximum dimension of from about 11 cm to about 15 cm in its lateral aspect. In this embodiment, the abovementioned linear edge is rounded and the device includes at least one lip near to the linear edge on the body between the linear edge and the handle. The first, handle, portion has a first and a second side, at least one of which sides has at least a partial knob-like projection adapted for use in applying pressure to derma. The other side has a curved, double-beveled edge with a finger receiving recess adapted for application to bony prominences. The device has at least one surface grip enhancement and the first portion is configured as a handle bar to facilitate grasping the device.

The invention further includes a method of ameliorating bodily tissue including the steps of identifying an area of bodily tissue of a subject for amelioration, providing a device for application to bodily tissue such as described above, or with additional or alternative features as described hereinbelow. The method further includes grasping the device, manipulating the device to contact the subject's bodily tissue with an application portion of the device, and applying pressure to the bodily tissue of the subject, whereby amelioration of the tissue is achieved.

According to one aspect of the invention, one or a pair of lips may be installed near the linear edge to prevent lotion from spreading upward reaching a practitioner's fingers and causing finger slippage. In addition, they also allow for comfortable placement of fingers while gripping the device.

According to another aspect of the invention, a hemispherical or other at least partial knob-like projection can be installed on one side/end of the first, holder, portion for additional modes of soft tissue mobilization and trigger point release. Furthermore, the edge of the knob where it meets the handle may be filleted to prevent accumulation of lotion and other residues.

According to yet another embodiment of the invention, a double-beveled curved edge may be installed on at least one side of the first, holder portion of the device. This may be in alternative to, or in addition to (opposite to) the knob for deep tissue mobilization in generally smaller areas of the body, especially around bony prominences. Also, a finger-receiving recess with, e.g., a circular, semi-circular, or elliptical outline may be introduced with the curved edge to assist with gripping and thumb-placement while using the tool in different modes. The finger-receiving recess may also be modified such that its bottom is carved into a spoon-like feature.

According to still other embodiments of the invention, mono- or multi-layered anti-slipping surface grip enhancements may be installed on the body between the handle and the linear edge to prevent slipping of practitioners' fingers.

According to yet still another embodiment of the invention, a cavity or recess may be cut out of (or molded into) the body between the handle and the linear edge to create a bar handle configuration to facilitate comfortable gripping by a practitioner's hand. The whole or partial surface of the handle may be further modified with, e.g., raised surface nubs, recessed contact points or surface roughage to inhibit finger slippage. Furthermore, the raised surface nubs may constitute, e.g., an array of pyramidal frustums, hemispherical structures, or semi-cylindrical structures or inverted recesses approximating these structures.

DETAILED DESCRIPTION OF THE INVENTION

Figure 1A:
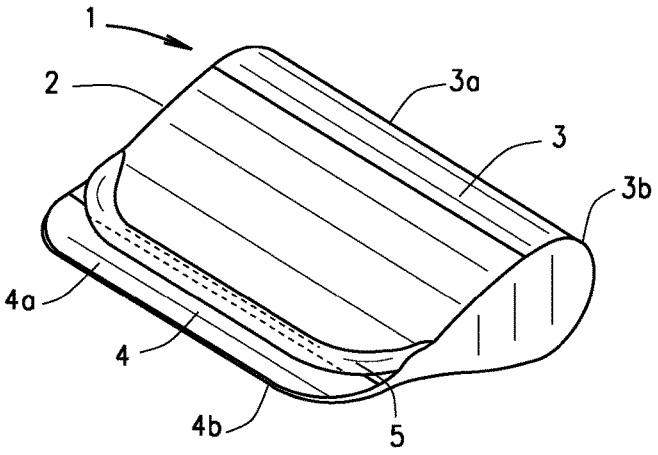
FIG. 1A and FIG. 1B are, respectively, perspective and side view illustrations of an embodiment of the inventive tool depicting, among other features, a lip near the linear edge of the device.

The foregoing summary, as well as the following detailed description of certain embodiments will be better understood when read in conjunction with the appended drawings. As used herein, an element or step recited in the singular and proceeded with the word "a" or "an" should be understood as not excluding the plural of said elements or steps, unless such exclusion is explicitly stated. Furthermore, references to "one embodiment" or "an embodiment" are not intended to be interpreted as excluding the existence of additional embodiments that also incorporate the recited feature(s). Moreover, unless explicitly stated to the contrary, embodiments "comprising" or "having" an element or a plurality of elements having a particular property or feature may include additional such elements not having that property or feature.

The invention provides a tool useful for ameliorating the bodily tissue of a subject. The tool is comfortable to hold, thus mitigating unnecessary strain on users' wrists and hands. The device is relatively simple to use and does not require extensive training to operate, compared to conventional IASTM tools. The inventive device is readily customizable to different hand sizes. Moreover, the inventive tool has multiple modalities and advantages which allow for enhanced and effective treatments generally requiring only the one tool to ameliorate a variety of bodily tissues and body tissue issues. Thus, the inventive IASTM tools presented are relatively affordable and easy to use with multi-functional modalities and ergonomic and comfortable gripping.

The invention provides an IASTM tool that offers multiple modalities to assist in ameliorating bodily tissue, including soft tissue mobilization, stimulation of superficial tissue, deep tissue mobilization, breaking up of scar tissue, and tissue massaging. See Table 1 for a partial list of conditions for which the inventive tool can provide amelioration.

The inventive tool may be made of various materials, of varying hardness, stiffness, and resiliency, such as plastics, polymers, resins and metals such as stainless steel. In particular, it is envisioned that various plastic or composite materials of a type which can readily be customized using three-dimensional printing technologies or injection molding may be utilized to enhance the customizable aspects of providing the inventive tool for wider IASTM use.

The inventive tool, in its basic form, comprises a device having a body with substantially a teardrop shape in its vertical section, having a curved substantial end comprising the handle, and a tapered converging double-beveled linear edge for application to tissue.

Described in more detail in relationship to its general orientation, components and function, the inventive tool comprises a device for application to bodily tissue, the device including a body having a substantially teardrop shape in a vertical section. In a longitudinal aspect, the body includes a first and a second portion at or toward corresponding first and second ends of the device. The first portion of the device corresponds at least in part to a substantially bulbous part of the teardrop shape of the vertical section. This first portion is adapted for use as a handle and is adapted for ease of grasping and manipulation at this first (holder) end. The second portion of the device corresponds at least in part to a substantially tapered converging double-beveled linear edge of the teardrop shape of the vertical section. This second end is adapted for facilitated application of pressure by the device to bodily tissue.

The above-described device will generally, in a lateral aspect, include a handle portion having a generally cylindrical or partially cylindrical shape. However, other configurations of this lateral aspect, including those wherein the handle is non-cylindrical (e.g., having a hexagonal or octagonal configuration) are within the scope of the invention, provided that such configurations provide for a generally bulbous, palm-filling handle which is comfortable and ergonomic to hold.

As mentioned previously, the device is readily customizable to users having large, medium and small hands. Accordingly, the inventive tool can range from, e.g., a maximum dimension of from about 7.5 cm to about 11.5 cm in its longitudinal aspect and a maximum dimension of from about 11 cm to about 15 cm in its lateral aspect.

The double-beveled linear edge is generally rounded for comfortable application. However, in certain applications, e.g., where the device is used to vigorously scrape or scratch the bodily tissue, the edge can terminate at a sharp point to dig into and scrape the dermal surface. For ease in use, and to avoid unnecessarily negatively impacting the bodily tissue during application, for most embodiments and applications, however, a suggested minimum thickness for the outermost portion of the linear edge of the tool is about 0.20 cm.

Various features and additions may be installed onto the body to enhance the tool's use and performance. For example, a hemispherical or other partial knob or knob-like projection may be installed on one side of the first portion, or handle (holder), for additional modes of tissue mobilization and trigger point release. A secondary curved double-beveled tapered edge (the curved edge) may be installed, alternatively, or in addition thereto, such as on the other side of the first, or handle, portion of the device's body for use in bodily tissue amelioration, such as deep tissue mobilization or applications on smaller, e.g., bony, areas of the body.

The inventive tool may be further modified to facilitate easy handling and less discomfort when used by a practitioner. For example, a lip (or a pair of lips) may be installed near the linear edge to prevent lotion from spreading upward and reaching a practitioner's fingers. Additionally, mono- or multi-layered surface grip enhancements may be installed between the linear edge and the handle to prevent finger slippage. Alternatively, or additionally, a cavity, recessed area, or depression may be introduced, such as by cutting it out or molding it into the device's body between the linear edge and the handle to allow the handle to comfortably fit into the palm of a practitioner's hand between the thumb and fingers to provide a firm and comfortable grasp. In another embodiment, alternatively or additionally to the abovementioned surface grip enhancements, surface grip enhancements may further include grip enhancements to the surface of the handle itself which may be modified, e.g., to have raised surface nubs in various arrays covering the whole or partial surface of the handle. Similarly, surface grip enhancements such as surface dimpling or surface roughage in all such locations may be used to inhibit slippage. Furthermore, the added features, the knob and the curved edge, may also be modified. For example, the edge of the knob where it meets the handle may be filleted to prevent accumulation of lotion and other residues; and a finger-receiving recess may be introduced with the curved edge to assist with gripping and thumb-placement while using the tool in different modes.

Figure 1B:
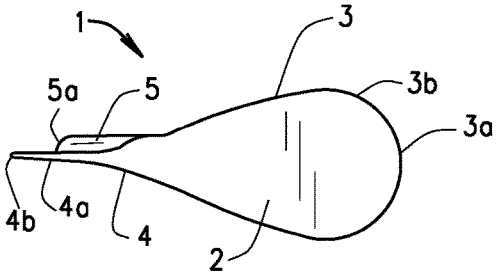

Accordingly, referring, e.g., to FIGS. 1A and 1B, embodiments of the inventive tool with a lip are illustrated. As shown in FIG. 1A, the inventive tool 1 in its basic form, comprises a body with a substantially teardrop shape in a vertical section of the device 2. The device has a first portion 3 including a bulbous portion having a usually curved perimeter surface corresponding with a first end 3*a* for use as the handle 3*b*, or holder portion. The device has a second portion 4 corresponding to a narrowing second end 4*a* (depicted as the thinning end of a teardrop in vertical section), including the tapered, converging double-beveled linear edge 4*b*. A lip 5, or lip-like protrusion, is introduced near the linear edge 4*b* and between the linear edge 4*b* and the first, handle-containing portion 3, to prevent lotion from spreading upward. Alternatively, a pair of lips 5 (on both upper and lower surfaces of the body 2) can be introduced. The surface of the lip 5 may be further modified such that the inner edge has a near-vertical wall 5*a* in order to accommodate comfortable placement of fingers while gripping the device. FIG. 1B is the side view of the basic inventive tool 1 with a lip 5.

Figure 2A:
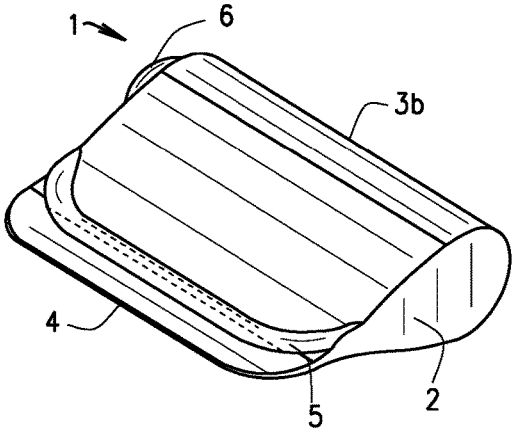
FIG. 2A and FIG. 2B are, respectively, perspective and rear view illustrations of embodiments of the inventive tool depicting, among other features, a knob-like projection on a side of the first, handle portion of the tool, including, in FIG. 2B depicting wherein the edge of the knob where it connects to the handle is filleted.
Figure 2B:
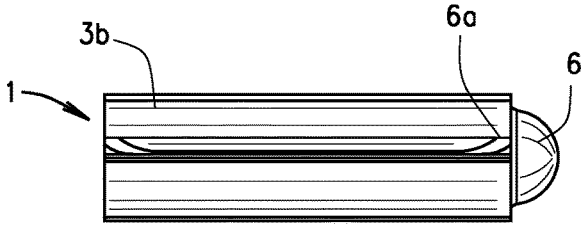

Referring to FIGS. 2A and 2B, illustrations of an embodiment of the inventive tool with a hemispherical knob or knob-like protrusion feature, are depicted. As shown in FIG. 2A, the inventive tool 1 is installed with a hemispherical knob 6 on one side of the handle 3*b*. The size and shape of the knob may vary depending on the application(s) to be made with the device. Furthermore, as depicted in FIG. 2B, the edge of the knob where it connects to the handle may include fillets 6*a* to prevent accumulation of lotion and other residues.

Figure 3A:
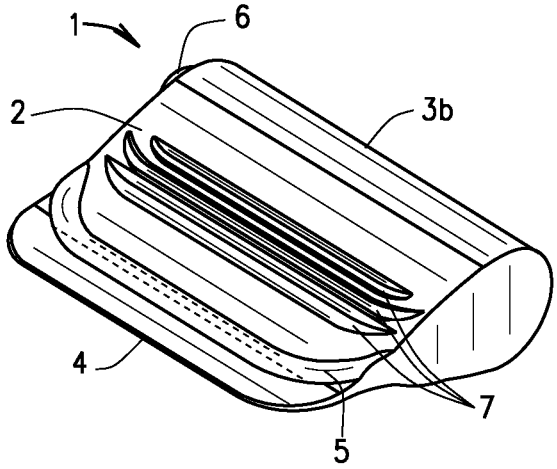
FIG. 3A and FIG. 3B are, respectively, perspective and side view illustrations of an embodiment of the inventive tool depicting, among other features, multi-layered anti-slipping surface grip enhancements.
Figure 3B:
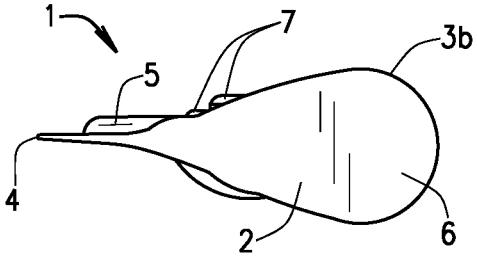
Figure 4A:
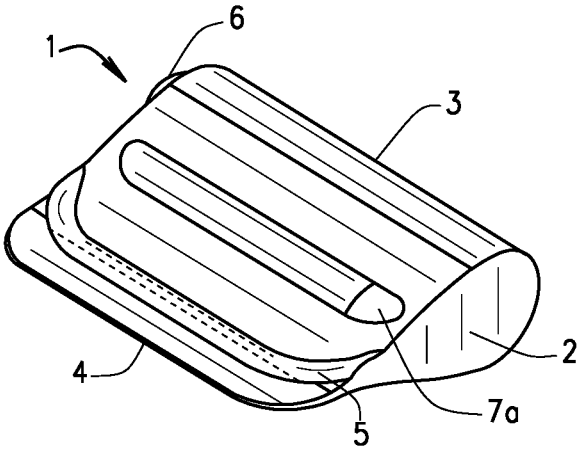
FIG. 4A and FIG. 4B are, respectively, perspective and side view illustrations of an embodiment of the inventive tool depicting, among other features, a mono-layered anti-slipping surface grip enhancement.
Figure 4B:
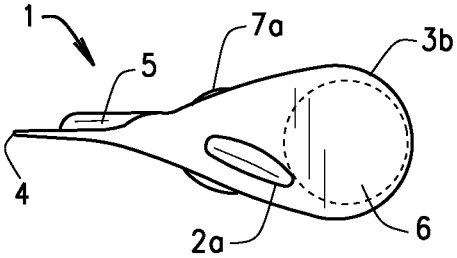

Referring to FIGS. 3A and B and 4A and B, illustrations of an embodiment of the inventive tool or device with multi- and mono-layered surface grips, are depicted, respectively. As shown in FIG. 3A, a set of multi-layered anti-slipping surface grip enhancements 7 are installed between the lip 5 and the handle 3*b*. As shown in FIG. 4A, a mono-layered grip enhancement 7*a* is alternatively installed. Furthermore, grip enhancements can be installed on both sides 2*a* on the body 2 (see FIG. 4B).

Figure 5:
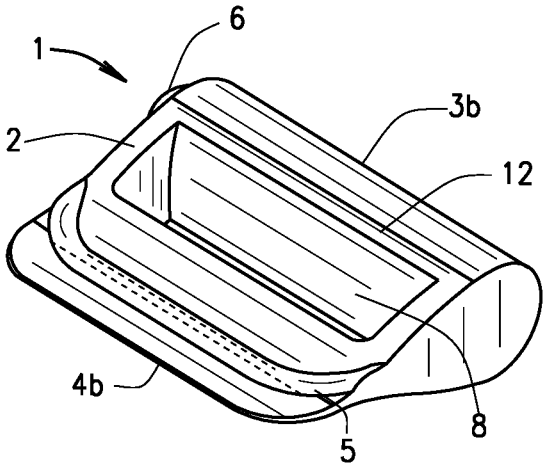
FIG. 5 is a perspective view illustration of an embodiment of the inventive tool depicting, among other features, a cavity cut into the body of the tool to create a bar handle.

Referring to FIG. 5 an illustration of an embodiment including a cavity cut out to create a handle bar are shown. As shown, e.g., in FIG. 5, a cavity 8 is carved out or otherwise created along the body 2, between the linear edge 4*b*, and the handle 3*b* to create a handle bar 12 for easy grasping of the tool at the handle bar 12 by a practitioner's thumb and fingers (see, e.g., FIGS. 8A-8D).

Figure 6A:
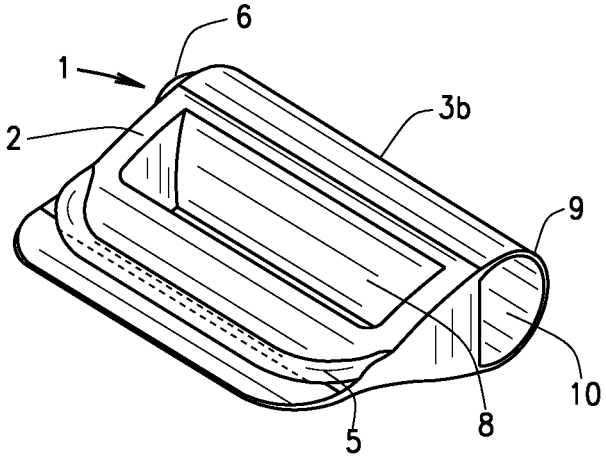
FIGS. 6A to 6D are various illustrations of embodiments of the inventive tool including, among other features, a curved, double-beveled tapered edge feature in various configurations.
Figure 6B:
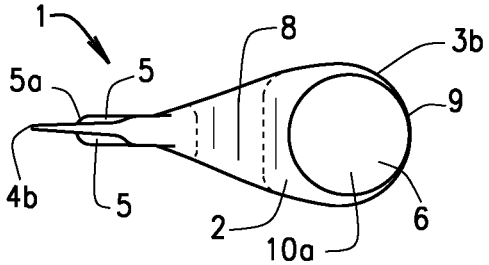
Figure 6C:
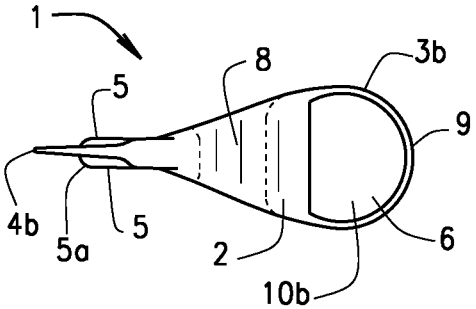
Figure 6D:
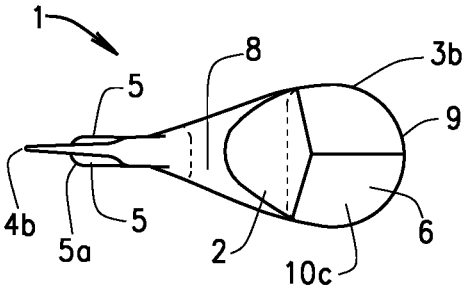

Referring to FIGS. 6A to 6D, illustrations of embodiments of the inventive tool with, among other features, a curved, double-beveled tapered edge feature on the side opposite of the knob 6, are shown. As shown in FIG. 6A, a curved double-beveled edge 9 with a finger-receiving recess 10, is introduced to the side of the handle 3*b* opposite of the knob end 6. The curved edge 9 is introduced for deep tissue mobilization in generally smaller areas of the body, especially around bony prominences (see FIG. 8C for illustration of use). The finger-receiving recess 10 is introduced with the curved edge 9 to assist with gripping and thumb-placement while using the tool 1 in different modes. The finger-receiving recess 10 may be created such that its bottom is carved into a spoon-like feature. Also, a finger-receiving recess with a circular 10*a* (as shown in FIG. 6B), semi-circular 10*b* (as shown in FIG. 6C), or elliptical 10*c* (as shown in FIG. 6D) outline may be introduced to further assist with gripping and thumb-placement.

Figure 7A:
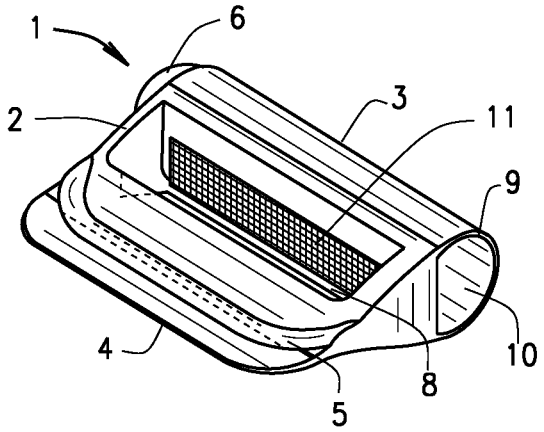
FIGS. 7A to 7D are various illustrations of embodiments of the inventive tool with handles having a variety of anti-slippage surface enhancements.
Figure 7B:
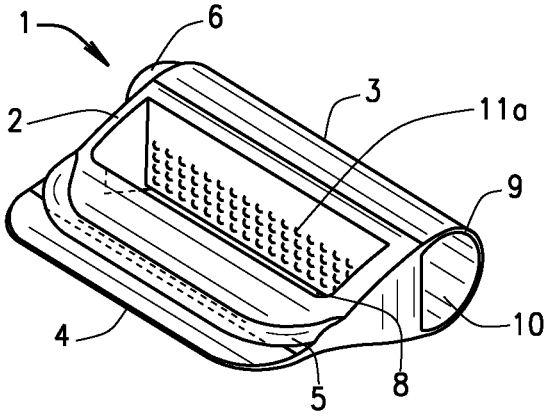
Figure 7C:
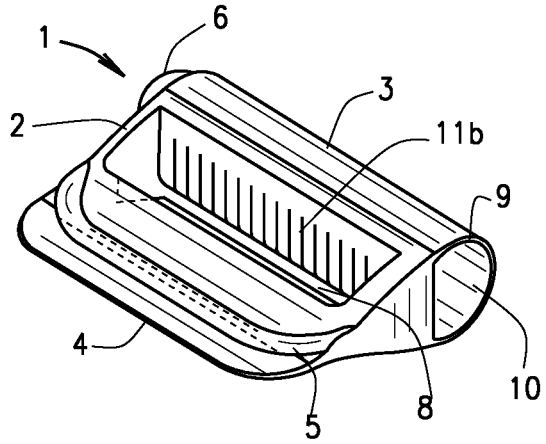
Figure 7D:
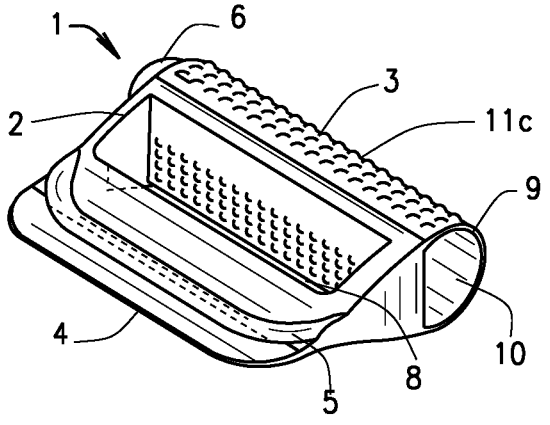

Referring to FIGS. 7A to 7D, embodiments of the inventive device with modified handle surfaces to inhibit slippage are shown. As shown in FIGS. 7A to 7C, the inner surfaces of the handle bar 12, are modified with raised surface nubs 11, 11*a* and 11*b*; and as shown in FIG. 7D, the entire surface of the handle bar 12 is modified with the raised surface nubs 11*c*. The raised surface nubs (11/11*a*/11*b*/11*c*) may further constitute, e.g., an array of pyramidal frustums (as shown in FIG. 7A), hemispherical structures (as shown in FIGS. 7B and 7D), or semi-cylindrical structures (as shown in FIG. 7C), to prevent slipping of a practitioner's hand.

Figure 8A:
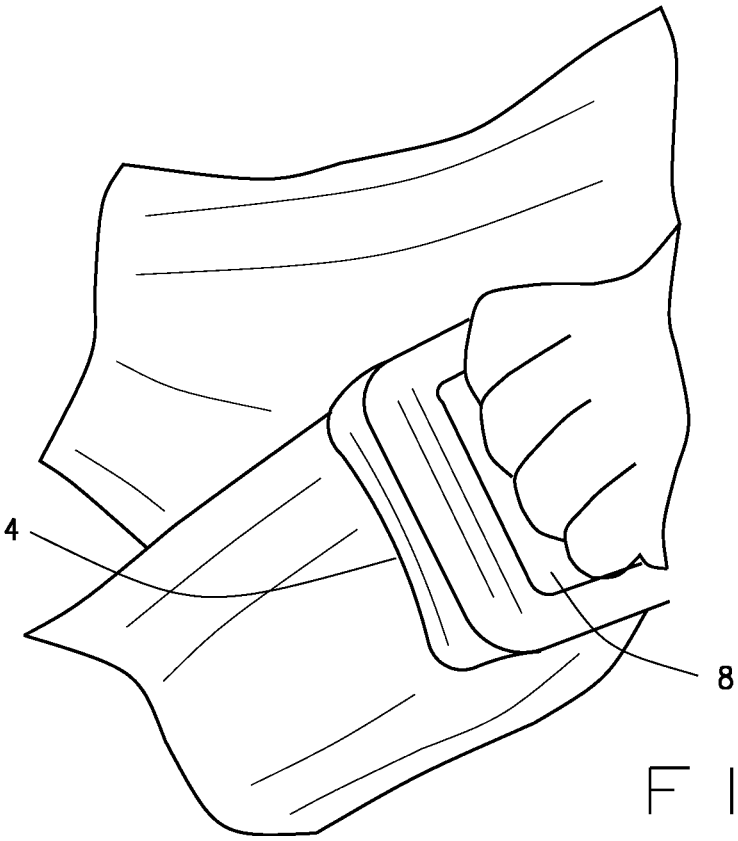
FIGS. 8A to 8E are illustrations of application of embodiments of the inventive tool used according to the methods of the invention illustrating the use of a variety of alternative tool application features to ameliorate bodily tissue at, respectively, (8A) a subject's upper thigh (using the tool's linear edge feature), (8B) a subject's outer thigh (using the tool's knob-like projection), (8C) a user grasping the tool using the handle bar having an anti-slippage surface feature, (8D) a subject's bony ankle prominences (using the tool's curved, double-beveled side indentation), and (8E) a subject's upper thigh (using the tool's linear edge where the tool is held by the user with fingers and thumb draped over the device).
Figure 8B:
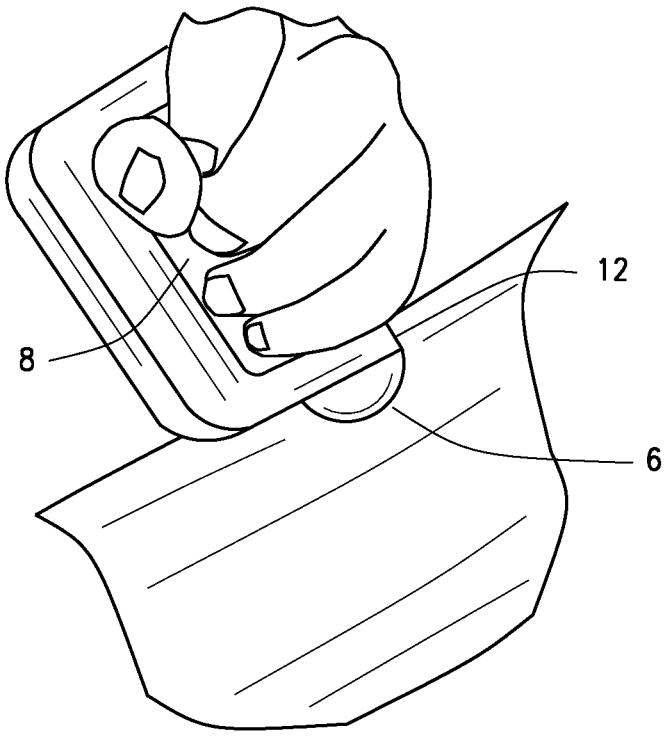
Figure 8C:
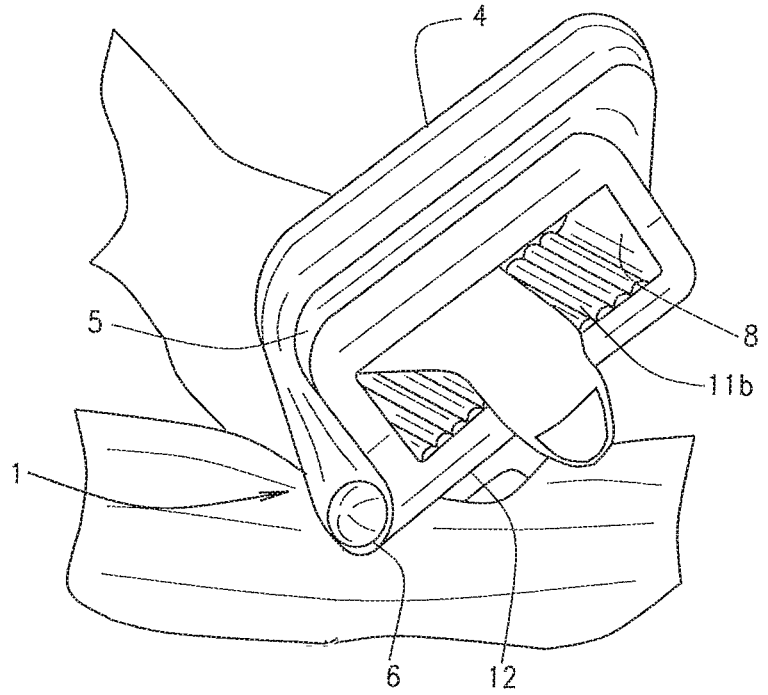
Figure 8D:
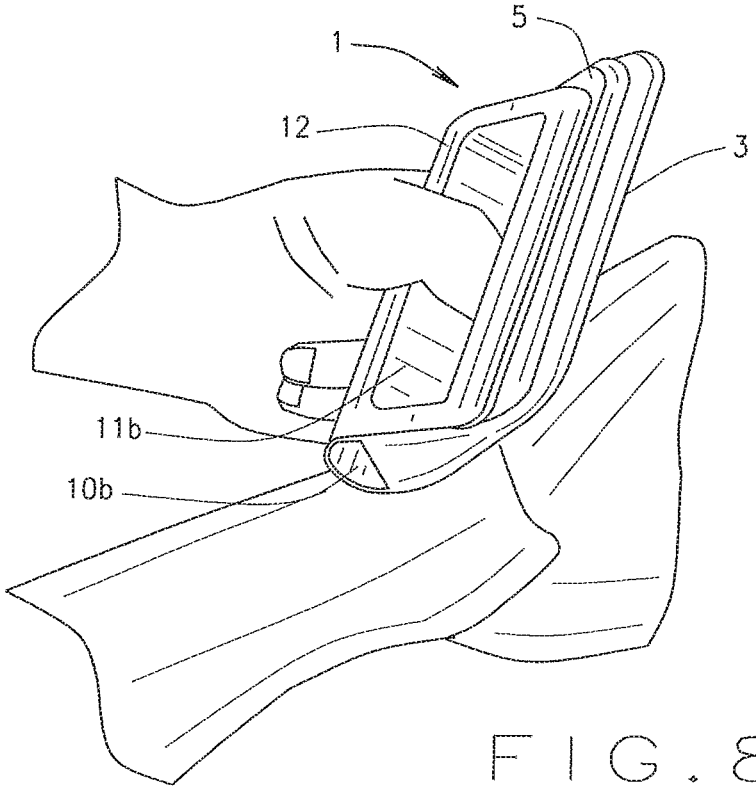
Figure 8E:
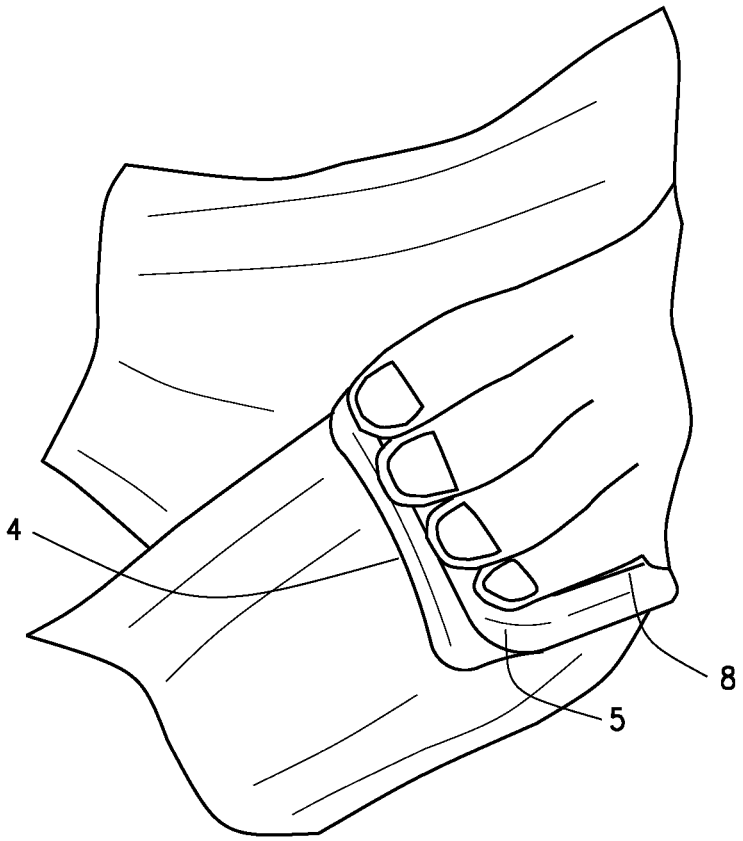

When the inventive tool is applied to ameliorate a subject's tissue, the device can be held in a variety of ways to bring pressure from one of the tool's application surfaces to an area of focus, depending on the specific need and circumstances. Two exemplary ways in which a user can grasp the tool include using the device's substantially teardrop shape to fit the contour of the user's hand while grasping it with thumb and fingers draped around the outer surface of the device. See FIG. 8E. Alternatively, the user can make use of the tool's handle to grasp it. See, e.g., FIGS. 8A to 8E. Further referring to FIG. 8A to FIG. 8E, illustrations are provided of the application of embodiments of the inventive tool used according to the method of the invention. These are illustrative of ways a variety of alternative or complementary application features of the inventive tools can be used to ameliorate bodily tissue. Respectively, FIG. 8A shows a subject's upper thigh having pressure applied to it using the tool's linear edge feature. In FIG. 8B, a subject's outer thigh undergoes instrument-assisted mobilization using the tool's knob-like projection located on the side of the handle. In FIG. 8C, use of the handle bar and anti-slippage grip enhancement features are illustrated as pressure is being applied to bodily tissue for amelioration. In FIG. 8D, a subject's bony ankle prominences receive sustained pressure using the tool's curved, double-beveled side edge feature. Finally, FIG. 8E illustrates, e.g., how the tool can be held with the user's fingers and thumb draped over the upper and lower surfaces of the tool to apply pressure to a subject's upper thigh. In each of FIGS. 8A-8E, the user illustrates various methods of holding and manipulating the inventive device, more generally as described below.

Accordingly, in general, a method of ameliorating bodily tissue as set forth herein includes the steps of identifying an area of bodily tissue of a subject for amelioration, and providing a device for application to the bodily tissue comprising a body having a substantially teardrop shape in a vertical section, the body in a longitudinal aspect comprising a first and second portion toward corresponding first and second ends of the device. In this embodiment, the first portion includes a substantially bulbous handle as such part of the teardrop shape (of the vertical section) which is adapted for ease of grasping and manipulation at the first end, and a second portion corresponding to a substantially tapered converging double-beveled linear edge (of the teardrop shape of the vertical section) which is adapted to facilitate application of this linear edge to bodily tissue. According to the method, the device as described is grasped by the user and manipulated so as to contact the subject's bodily tissue with an application portion of the device, at which time pressure is applied to the bodily tissue of the subject, usually repetitively, and with force, whereby the tissue is ameliorated.

The above method of ameliorating bodily tissue can include application of a lotion, such as one including aloe or other components of a non-staining cream, heat, or both, before, during or after application of the inventive tool to assist in the method.

As mentioned previously, an advantage of application of various methods as set forth herein, or variants thereof, is that embodiments of the instant inventive device contain multiple application surfaces, such as the linear edge, and the alternative surfaces provided at both sides of the handle, including the knob-like projection adapted for use in applying pressure to derma and the other side of the handle which can include a curved, double-beveled edge with a finger receiving recess of various configurations, adapted for use around bony prominences and other surfaces. Moreover, tools including many of the improvements disclosed herein, ranging from the handle bar to the various anti-slippage features and comfort and ergonomic enhancements may be employed in a wide variety of circumstances where IASTM tools are useful. Included among the various applications for use of the instant ISATM tools are those for ameliorating bodily tissue outlined in Table 1

Conditions for Use of IASTM

| |
|---|
| Acute Ankle Sprains (Advanced Technique) |
| Back Pain |
| Carpal Tunnel Syndrome |
| Chronic Ankle Sprains |
| Chronic Joint Swelling Associated with Sprains/Strains |
| DeQuervain's Syndrome |
| Heel Pain/Achilles Tendinitis |
| Hip Pain (Replacements) |
| IT Band Syndrome |
| Ligament Sprains |
| Medial Epicondylitis, Lateral Epicondylitis |
| Muscle Strains |
| Musculoskeletal Imbalances |
| Myofascial Pain and Restrictions |
| Neck Pain |
| Non-Acute Bursitis |
| Patellar Tendinitis |
| Plantar Fasciitis |
| Post-Surgical and Traumatic Scars |
| Rotator Cuff Tendinitis |
| RSD (Reflex Sympathetic Dystrophy) |
| Scars (Surgical, Traumatic) |
| Shin Splints |
| Tibialis Posterior Tendinitis |
| Trigger Finger |

Each of the various conditions of bodily tissue discussed herein can be ameliorated using the inventive device and methods described herein. Moreover, the various combination of features as described above can be customized specifically to the features of the specific area of bodily tissue, the nature of the subject's condition, and, e.g., adjusted for a smaller or larger size of hand of the tool's user.

It is to be understood that the above description is intended to be illustrative, and not restrictive. For example, many of the above-described embodiments and/or aspects thereof can be used in combination with each other. In addition, many modifications can be made to adapt a particular situation or material to the teachings of the various embodiments of the invention, the embodiments are by no means limiting and are exemplary embodiments. Many other embodiments will be apparent to those skilled in the art upon reviewing the above description. The scope of the various embodiments of the invention should, therefore, be determined with reference to the appended claims, along with the full scope of equivalents to which such claims are entitled.

It should be noted that in the following claims, the terms "first, or "second", etc. are used merely as labels, and are not intended to impose numerical requirements or unspecified limitations on their objects.

This patent application is intended to cover any variations, uses, or adaptations of the invention following, in general, the principles of the invention and including such departures from the present disclosure as come within known or customary practice within the art to which the invention pertains and as may be applied to the essential features hereinbefore set forth.

What claimed is:

1. A device for application to bodily tissue, said device comprising:

a single-piece body having a substantially teardrop shaped longitudinal cross-section across an entire width of the body, the body comprising a first portion and a second portion, the first portion comprising a substantially flat top surface, a substantially flat bottom surface, a continuously arcuate back disposed between the substantially flat top and bottom surfaces, and a first lateral side and an opposing second lateral side, the first portion providing a substantially bulbous handle part of the device adapted for ease of grasping and manipulation at the first portion, and the second portion integrally formed with and extending longitudinally from the first portion and comprising a substantially tapered converging double-beveled lateral linear edge adapted for facilitated application to the bodily tissue at the second portion; the second portion additionally including at least one lip comprising a vertical wall extending substantially vertically from a surface of the second portion near the double-beveled lateral linear edge and a flat horizontal wall extending substantially orthogonally from the vertical wall, the at least one lip extending across substantially the entire width of the body.

2. The device of claim 1 wherein, in a lateral aspect, the handle part comprises a generally cylindrical or partially cylindrical shape.

3. The device of claim 2 wherein the device has a maximum dimension of from about 7.5 cm to about 11.5 cm in a longitudinal aspect and a maximum dimension of from about 11 cm to about 15 cm in its lateral aspect.

4. The device of claim 1 wherein the double-beveled lateral linear edge is rounded.

5. The device of claim 1 wherein at least one of the first and second lateral sides has a knob-like projection adapted for use in applying pressure to derma.

6. The device of claim 1 wherein at least one of the first and second lateral sides has a curved, double-beveled edge with a finger receiving recess adapted for application to bony prominences.

7. The device of claim 1 having at least one surface grip enhancement.

8. The device of claim 7 wherein the at least one surface grip enhancement comprises raised surface nubs.

9. The device of claim 1 wherein the first portion is configured to comprise a handle bar to facilitate grasping.

10. The device of claim 9 wherein the handle bar is formed by incorporating a cavity or recess between the double-beveled lateral linear edge and the handle part.

11. The device of claim 1 wherein at least one of the first and second lateral sides has a knob-like projection adapted for use in applying pressure to derma and the other side has a curved, double-beveled edge with a finger receiving recess adapted for use around bony prominences.

12. The device of claim 11 having at least one surface grip enhancement.

13. The device of claim 12 wherein the first portion is configured to comprise a handle bar to facilitate grasping.

14. A device for application to bodily tissue comprising:

A single-piece body having a substantially teardrop shaped longitudinal cross-section across an entire width of the body, the body comprising a first portion and a second portion, the first portion comprising a substantially flat top surface, a substantially flat bottom surface, a continuously arcuate back disposed between the substantially flat top and bottom surfaces, and a first lateral side and an opposing second lateral side, the first portion providing a substantially bulbous part of the device adapted for use as a handle for ease of grasping and manipulation at the first portion, and the second portion integrally formed with and extending longitudinally from the first portion and comprising a substantially tapered converging double-beveled lateral linear edge adapted for application to bodily tissue at the second portion, wherein in a lateral aspect, the handle comprises a generally at least partial cylindrical shape, wherein the device has a maximum dimension of from about 7.5 cm to about 11.5 cm in a longitudinal aspect and a maximum dimension of from about 11 cm to about 15 cm in its lateral aspect, the double-beveled lateral linear edge is rounded, the second portion additionally comprising at least one lip comprising a vertical wall extending substantially vertically from a surface of the second portion near to the double-beveled lateral linear edge and a flat horizontal wall extending substantially orthogonally from the vertical wall, the at least one lip extending across substantially the entire width of the body, wherein at least one of the first and second sides has a knob-like projection adapted for use in applying pressure to derma and the other of the first and second side has a curved, double-beveled edge with a finger receiving recess adapted for application to bony prominences, and the device has at least one surface grip enhancement, and the first portion is configured as comprising a handle bar to facilitate grasping.

15. A method of ameliorating bodily tissue comprising the steps of:

a) identifying an area of the bodily tissue of a subject for amelioration, b) providing a device for application to the bodily tissue comprising a single-piece body having a substantially teardrop shaped longitudinal cross-section across an entire width of the body, the body comprising a first portion and a second portion, the first portion comprising a substantially flat top surface, a substantially flat bottom surface, a continuously arcuate back disposed between the substantially flat top and bottom surfaces, and a first lateral side and an opposing second lateral side, the first portion providing a substantially bulbous handle part of the device adapted for ease of grasping and manipulation at the first portion, and the second portion integrally formed with and extending longitudinally from the first portion and comprising a substantially tapered converging double-beveled lateral linear edge adapted for facilitated application to the bodily tissue at the second portion; the second portion additionally including at least one lip comprising a vertical wall extending substantially vertically from a surface of the second portion near the double-beveled lateral linear edge and a flat horizontal wall extending substantially orthogonally from the vertical wall, the at least one lip extending across substantially an entire width of the body, c) grasping the device, d) manipulating the device to contact the subject's bodily tissue with an application portion of the device, and e) applying pressure to the bodily tissue of the subject.

16. The method of claim 15 further comprising the step of applying a lotion to the identified bodily tissue.

17. The method of claim 15 further comprising the step of applying heat to the identified bodily tissue.

18. The method of claim 15 wherein at least one of the first and second lateral sides has a knob-like projection adapted for use in applying pressure to derma and the other side has a curved, double-beveled edge with a finger receiving recess adapted for application to bony prominences.

19. The method of claim 15 wherein the device has at least one surface grip enhancement.

* * * * *